US006772704B1

(12) United States Patent
Naud et al.

(10) Patent No.: US 6,772,704 B1
(45) Date of Patent: Aug. 10, 2004

(54) METHOD FOR QUANTIFYING DESIGN PARAMETERS FOR A SHIP ROLL STIMULATION SYSTEM

(75) Inventors: Steven F. Naud, Lynn Haven, FL (US); Max D. Weber, Panama City Beach, FL (US); Lei Lani Lucero, Hampton, VA (US); J. Dexter Bird, III., Hampton, VA (US); Martin D. Fink, Bethesda, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 898 days.

(21) Appl. No.: 09/613,522

(22) Filed: Jul. 10, 2000

(51) Int. Cl.[7] ..... B63B 43/06; B63B 43/08
(52) U.S. Cl. ..... 114/125; 114/124; 703/8
(58) Field of Search ..... 114/121, 122, 114/124, 125; 703/8; 73/65.04

(56) References Cited

U.S. PATENT DOCUMENTS 1,730,941 A * 10/1929 Myers ..... 114/124
2,023,548 A * 12/1935 Brooks ..... 235/61 T
2,024,822 A * 12/1935 Hermann ..... 114/125
2,341,563 A * 2/1944 Johann et al. ..... 73/65.04
2,431,405 A * 11/1947 Johann et al. ..... 73/65.04
4,822,281 A * 4/1989 Zajicek ..... 434/29

* cited by examiner

*Primary Examiner*—Sherman Basinger
(74) *Attorney, Agent, or Firm*—James T. Shepherd; Donald G. Peck

(57) ABSTRACT

A method is provided for quantifying design parameters for a moving mass ship roll stimulation system given a maximum angle of roll $\theta_{MAX}$ to be induced for a ship, a righting moment $R_M$ per degree of list for the ship, a natural roll period $T_N$, a damping ratio $\zeta$ for the ship and a center of gravity for the ship. A total induced moment expression at the natural roll period $T_N$ is determined for the moving mass ship roll stimulation system as a function of a plurality of design parameters therefor. The total induced moment expression is equated to $2\zeta\theta_{MAX}R_M$ and values for the design parameters are selected to satisfy the equality.

12 Claims, 1 Drawing Sheet

METHOD FOR QUANTIFYING DESIGN PARAMETERS FOR A SHIP ROLL STIMULATION SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to ship roll stimulation, and more particularly to a method of quantifying design parameters for a ship roll stimulation system.

BACKGROUND OF THE INVENTION

Understanding roll motion for a particular type of ship is important for planning the loading/unloading of the ship as well as how the ship will react in heavy weather. Since inherent characteristics vary from ship to ship, testing of ship roll must be carried out on a ship-by-ship basis. Currently, the most widely-used methods of generating roll motion include sallying, snap load release, waiting for weather conditions to induce roll, and the use of motion tables. Sallying involves running a number of sailors across the deck of a ship. While useful for quickly checking the natural frequency period of the ship, sallying is not a consistent sustainable method for producing roll motion and is not a cost effective use of personnel. In snap load release methods, a ship with a crane hoists a heavy load over side and "snap" releases the load. This method is effective for measuring righting moment, natural frequency and roll damping, but cannot be used for consistent roll generation. Furthermore, snap releasing of the load is stressful on the equipment and can be risky for personnel owing to the large weights used. The study of roll motion that relies on weather conditions to induce roll is the more traditional method, but is inconsistent, highly unreliable and not a cost effective use of personnel or equipment. Motion tables are typically hydraulically driven "decks" that can simulate all of the various ship motions. However, they are limited in size and power, very expensive to build and operate, and do not provide a realistic operating environment for use in training.

Other more sophisticated ship roll stimulation systems include: moving mass systems using counter rotating weights, a weighted cart or active flume tanks; force systems using ballast tanks or weighted anchors; and torque systems using pivoting gyroscopes.

In moving mass systems, the transfer of weight across the breadth of the ship creates the moment, or torsion, used to generate ship roll. The counter rotating weight system utilizes two equally weighted carts synchronously rotating about two shafts in opposing directions. The weighted cart system involves linearly moving a massive cart back and forth across the ship centerline. The active flume tank system uses a U-shaped tank, typically filled with water, and pushes the fluid back and forth.

In force systems, a force is generated at some distance from the ship centerline to generate a moment. For example, ballast tanks can be placed on the outboard flanks of a ship and have pressurized air cycled in and out of the tanks to push water and generate buoyant forces weighted anchors can be placed on each side of the ship and have winches selectively pull on one anchor and then the other to create the cycled forces needed.

In a torque system using a pivoting gyroscope, torque can be created directly by rotating and counter-rotating the gyroscope against the inertial mass of the spinning flywheel. Each of these systems and numerous others can be used to create the moment required to generate ship roll, however, there has been no reliable scientific method previously developed for sizing or quantifying the various design parameters of each of these systems for the purpose of stimulating consistent, repeatable roll. Rather, trial and error methodologies have governed ship roll stimulation system design leading to inconsistent and often non-repeatable or very limited roll motion testing.

SUMMARY OF THE INVENTION

Accordingly, it is an object of the present invention to provide a method that aids in the design of a ship roll stimulation system for a particular ship.

Another object of the present invention is to provide a method for quantifying design parameters for a ship roll stimulation system.

Still another object of the present invention is to provide a simple method for quantifying design parameters for any moving mass ship roll stimulation system.

Other objects and advantages of the present invention will become more obvious hereinafter in the specification and drawings.

In accordance with the present invention, a method is provided for quantifying design parameters for a ship roll stimulation system. A ship to be tested has a maximum angle of roll $\theta_{MAX}$ that needs to be induced. A plurality of inherent ship parameters that are provided (or determined) include a righting moment $R_M$ per degree of list, the ship's natural roll period $T_n$, a damping ratio $\zeta$ and a ship's center of gravity. For a particular moving mass ship roll stimulation system which has been selected, a total induced moment expression at the ship's natural roll period $T_n$ is determined. The total induced moment expression includes a primary moment component and a secondary moment component that are functions of a plurality of design parameters for the moving mass ship roll stimulation system. The total induced moment expression is equated to $2\zeta\theta_{MAX}R_M$ and values for the design parameters are selected to satisfy the equality.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
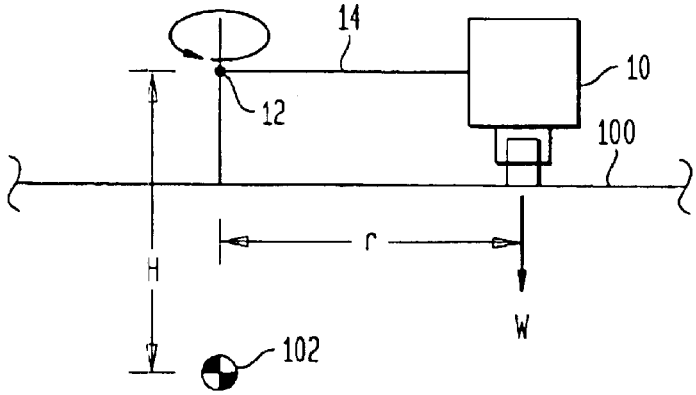
FIG. 1 is a schematic view of the geometric design variables for a rotating object ship roll stimulation system.

A ship roll stimulation mechanism must have the ability to apply a periodic moment to the ship. There are two fundamental types of ship roll stimulation mechanisms, those that apply a force between the ship and some fixed object and those that utilize a moving mass. Early studies examined several types of force application systems, such as cables attached to concrete weights below the ship, barges alongside, or pier structures. The large forces involved and the complexity of the mechanism made most of these systems impractical. Furthermore, these systems are generally restricted to training facilities. Moving mass systems, on the other hand, are generally self-contained and can be easily moved with the ship, permitting testing operations and training exercises to be conducted at a variety of locations and in different environments. For these reasons, the method of the present invention is directed to quantifying design parameters for a moving mass ship roll stimulation system.

The primary moment-producing mechanism of a moving mass system results from the periodic lateral displacement of a large weight from one side of the ship to the other. A secondary effect with all moving mass systems is due to the inertial forces that occur when the mass is accelerated during its change in direction. These accelerations may producee large forces that act on a moment arm with respect to the center of gravity of the ship. The resultant moments can add to or subtract from the primary moment produced by the mechanism, thereby increasing or decreasing its overall effectiveness to produce ship roll. These secondary moments typically are less than the primary moment, but are not insignificant and appear as a substantial percentage of the primary moment. They are inversely proportional to the period squared, and are also proportional to some characteristic linear measurement that is a function of the design of the stimulation mechanism, which involves the distance between the ship's vertical center of gravity and the direction of acceleration of the mass.

The present invention is a method for quantifying the design moment needed for any stimulation system, e.g., moving mass, force or torque systems, that involves the use of a periodic moment producing device with an adjustable frequency. By way of illustrative examples, the present invention will be described in detail below for two moving mass systems, i.e., the rotating weighted object system and the active flume tank system.

Using the present invention, a moving mass ship roll stimulation system can be designed with knowledge of a few basic ship-inherent parameters and the magnitude of the roll angle to be induced. In general, the present invention can be used with any ship, barge or other floating vessel (hereinafter referred to only as "ship") for which a variety of ship-inherent parameters are known or can be determined as would be well understood by one of ordinary skill in the art. Specifically, four ship-inherent parameters must be known/determined:

Righting moment $R_m$, (lb-ft/degree)

Natural roll period $T_n$ (seconds)

Damping ratio $\zeta$

Vertical location of the ship's center of gravity

The righting moment is expressed as a torque per unit angle and, if not known, can be determined by conducting an inclining experiment. This involves measuring the change in the angle of the ship, or its list, as a known weight is moved across the deck. Lifting a known weight over the side of the ship with the ship's crane can also provide a rough means of estimating the righting moment.

The natural roll period can be determined, if not known, by sallying the ship or otherwise inducing a small roll angle and then releasing to allow the ship to roll freely. The natural roll period is the time between two successive peak roll angles on the same side of the ship. The natural roll period $T_n$ is the desired operating period for the roll stimulation system and will generate the greatest roll output for any given moment induced by the system.

The damping ratio can be measured if it is not known. It is assumed that the damped system response is reasonably described by a second-order, linear differential equation, and that the damping moment is proportional to the roll angular velocity. In practice it has been observed that the damping coefficient is non-linear as the actual damping moment is more closely proportional to the angular velocity squared. However, it is sufficient to consider an effective damping ratio for a given forced roll angle that is equivalent to a linear damping coefficient that would remove the same amount of energy as the actual non-linear damping during one complete cycle. Therefore, the damping ratio will be a function of the maximum roll angle. Finally, the vertical center of gravity of a ship is generally provided as a ship specification. It should be noted that all of these values vary with loading conditions, but a reasonably narrow range can be identified at the nominal operating conditions.

For any ship roll stimulation system designed to produce a desired maximum roll angle $\theta_{MAX}$, an equation for the static moment $S_M$ required was developed using vibration theory. The static moment is described as the maximum moment produced by the system when held at the peak position or force. For a mass moving system, this is when the mass is placed at the furthest position from the ship centerline. This equation can be expressed as $$S_M=2\zeta\theta_{MAX}R_m \tag{1}$$

It is this static moment that will ultimately determine the system size required to obtain the desired roll angle when operating the stimulation system at the ship's natural roll period $T_n$. This is accomplished by equating the static moment $S_M$ to an expression describing the total induced moment at the ship's natural roll period. This total induced moment expression includes both the primary and secondary moments produced by the intended system. From this equation) the system's design variables are selected to satisfy the equality.

The present invention will now be described in greater detail by way of example for a rotating object system and an active flume tank system. Referring first to FIG. 1, a rotating object system has a rollable object 10 of weight W coupled to a center of rotation 12 at a radial distance r maintained by a tether 14. Center of rotation 12 is assumed to be located above the center of gravity 102 of a ship 100 by a height H. Object 10 is rotated about center of rotation 12 at a period T with the ideal operating period for any roll stimulation system being set at the natural roll period $T_n$ of the ship. The primary moment expression for this system is $$Wr \tag{2}$$

The secondary force is produced by the centripetal acceleration which is equal to the mass of object 10 times the centripetal acceleration or $$(W/g)(4\pi^2 r/T^2) \tag{3}$$

where g is the value for acceleration due to gravity. The resulting secondary moment is a product of this force acting about the moment arm produced by the height H. Thus, the secondary moment expression can be written as $$H(W/g)(4\pi^2 r/T^2)=4\pi^2 WrH/gT^2 \tag{4}$$

Therefore, in the general case, the total induced moment for the rotating object system is the combination of the primary and secondary moments or $$(Wr)+(4\pi^2WrH/gT^2) \quad (5)$$

which can also be written as $$(Wr)(1+4\pi^2H/gT^2) \quad (6)$$

Note that in equation (6), the "1" represents the primary moment while the second term is the portion resulting from the secondary moment. This second term can be additive or subtractive depending on whether H is above or below center of gravity 102.

In the present invention, a ship roll stimulation system's parameters are quantified by setting equation (1) for the static moment $S_M$ equal to the total induced moment at the ship's natural roll period or $$S_M=2\zeta\theta_{MAX}R_M=(Wr)\ (1+4\pi^2H/gT_n^2) \quad (7)$$

The parameters W, r and H are selected to maintain the equality of equation (7).

Figure 2:
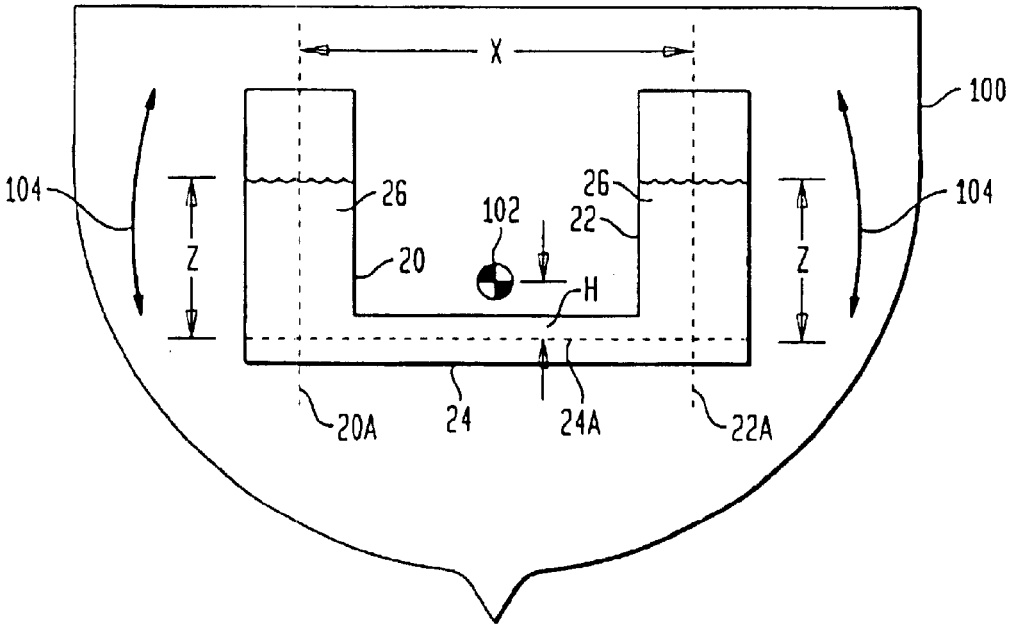
FIG. 2 is a schematic view of the geometric design variables for an active flume tank ship roll stimulation system.
Figure 3:
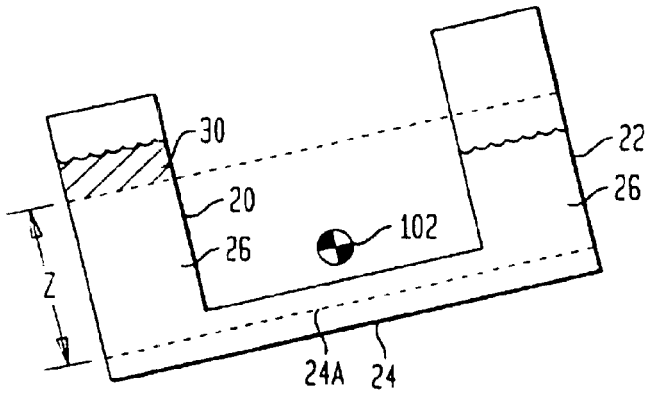
FIG. 3 is a schematic view of the ship roll stimulation system after it is partially pivoted.

Referring now to the drawings, and more particularly to FIG. 2, an active flume tank system provided on ship 100 is essentially a U-shaped tank having first and second tanks 20 and 22 coupled to one another for internal communication by a conduit 24. Tanks 20 and 22 are partially filled with a liquid 26, e.g., water, that also completely fills conduit 24. At an equilibrium position, the central vertical axis 20A and 22A of tanks 20 and 22, respectively, are aligned with the force of gravity. The distance between central vertical axes 20A and 22A is given as X. A central longitudinal axis 24A of conduit 24 is perpendicular to vertical axis 20A and 22A. At the equilibrium position illustrated in FIG. 2, the height of liquid 26 in each of tanks 20 and 22 above axis 24A is given as Z. A vertical distance H is defined between the ship's center of gravity 102 and axis 24A. The system pivots or rocks back and forth generally about the ship center of gravity 102 as indicated by arrows 104. One full period T is defined as the time it takes the system to complete one full rocking motion. Finally, W is the weight of liquid 26 above the equilibrium position at any given instant. For example, as shown in FIG. 3 with the active flume system pivoted to the left, the hatched area 30 represents the volume of liquid 26 to which weight W refers.

Applying a similar primary/secondary moment analysis as described above for the rotating object system, the total induced moment at the ship's natural roll period $T_n$ for an active flume tank system can be written as $$(WX)(1-4\pi^2(Z+H)/gT_n^2) \quad (8)$$

As in the previous example, a ship roll stimulation system's parameters are quantified by setting equation (1) for the static moment $S_M$ equal to the total induced moment at the ship's natural roll period or $$S_M=2\zeta\theta_{MAX}R_M=(WX)\ (1-4\pi^2(Z+H)/gT_n^2) \quad (9)$$

The parameters W, X, Z and H are selected to maintain the equality of equation (9).

The advantages of the present invention are numerous. The simple design methodology presented herein will allow a moving mass ship roll stimulation system to be customized for a particular application. The system can be designed prior to installation and use without resorting to costly, time-consuming trial and error methods. Consistent and repeatable ship roll motion testing can thus be achieved in an efficient manner. Further, the present invention can be used to design a ship roll stimulation "kit" that can easily be reconfigured on a case-by-case basis.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method for quantifying design parameters for a ship roll stimulation system, comprising the steps of:

selecting a ship to be tested;

selecting a maximum angle of roll $\theta_{MAX}$ to be induced for said ship;

obtaining a plurality of parameters inherent to said ship, said plurality of parameters including a righting moment $R_M$ per degree of list, the natural roll period $T_n$, a damping ratio $\zeta$ and a center of gravity;

selecting a moving mass ship roll stimulation system;

determining a total induced moment expression at said natural roll period $T_n$ for said moving mass ship roll stimulation system so-selected, said total induced moment expression including a primary moment component and a secondary moment component that are functions of a plurality of design parameters for said moving mass ship roll stimulation system;

equating said total induced moment expression to $2\zeta\theta_{MAX}R_M$; and selecting values for said plurality of design parameters to satisfy said step of equating.

2. A method according to claim 1 wherein said moving mass ship roll stimulation system is an active flume tank system having first and second tanks, said first and second tanks having vertical axes separated a distance X, said first and second tanks internally coupled to one another by a conduit having a central longitudinal axis perpendicular to said vertical axes wherein, when said first and second tanks are partially filled with a liquid, said conduit is completely filled with said liquid, said first and second tanks being partially filled with said liquid up to a height Z above said central longitudinal axis of said conduit when said vertical axes are aligned with gravity.

3. A method according to claim 2 wherein said total induced moment expression is $$(WX)(1-4\pi^2(Z+H)/gT_n^2)$$

wherein, for a selected position of said active flume tank system on said ship,

W is the weight of said liquid above said height Z in one of said first and second tanks at any given instant, H is a vertical distance between said central longitudinal axis of said conduit and said center of gravity of said ship, and g is the value for acceleration due to gravity.

4. A method according to claim 2 further comprising the step of selecting said liquid to be water.

5. A method according to claim 1 wherein said moving mass ship roll stimulation system is a rotating object system having an object of weight W coupled at a radial distance r to a center of rotation.

6. A method according to claim 5 wherein said total induced moment expression is $$(Wr)(1+4\pi^2H/gT_n^2)$$

wherein, for a selected position of said rotating object system on said ship with said center of rotation vertically aligned with said center of gravity of said ship, H is a vertical distance between said center of rotation and said center of gravity of said ship, and g is the value for acceleration due to gravity.

7. A method for quantifying design parameters for a moving mass ship roll stimulation system given a maximum angle of roll $\theta_{MAX}$ to be induced for a ship, a righting moment $R_M$ per degree of list for the ship, a natural roll period $T_n$, a damping ratio $\zeta$ for the ship and a center of gravity for the ship, said method comprising the steps of:

determining a total induced moment expression at said natural roll period $T_n$ for the moving mass ship roll stimulation system as a function of a plurality of design parameters for the moving mass ship roll stimulation system;

equating said total induced moment expression to $2\zeta\theta_{MAX}R_M$; and selecting values for said plurality of design parameters to satisfy said step of equating.

8. A method according to claim 7 wherein the moving mass ship roll stimulation system is an active flume tank system having first and second tanks, said first and second tanks having vertical axes separated a distance X, said first and second tanks internally coupled to one another by a conduit having a central longitudinal axis perpendicular to said vertical axes wherein, when said first and second tanks are partially filled with a liquid, said conduit is completely filled with said liquid, said first and second tanks being partially filled with said liquid up to a height Z above said central longitudinal axis of said conduit when said vertical axes are aligned with gravity.

9. A method according to claim 8 wherein said total induced moment expression is $$(WX)(1-4\pi^2(Z+H)/gT_n^2)$$

wherein, for a selected position of said active flume tank system on the ship,

W is the weight of said liquid above said height z in one of said first and second tanks at any given instant, H is a vertical distance between said central longitudinal axis of said conduit and said center of gravity of the ship, and g is the value for acceleration due to gravity.

10. A method according to claim 8 further comprising the step of selecting said liquid to be water.

11. A method according to claim 7 wherein the moving mass ship roll stimulation system is a rotating object system having an object of weight W coupled at a radial distance r to a center of rotation.

12. A method according to claim 11 wherein said total induced moment expression is $$(Wr)(1+4\pi^2H/gT_n^2)$$

wherein, for a selected position of the rotating object system on the ship with said center of rotation vertically aligned with said center of gravity of the ship, H is a vertical distance between said center of rotation and said center of gravity of the ship, and g is the value for acceleration due to gravity.

* * * * *